US005241886A

United States Patent [19]

Church et al.

[11] Patent Number: 5,241,886

[45] Date of Patent: Sep. 7, 1993

[54] APPARATUS AND METHODS FOR CUTTING RODS INTO LENGTHS FOR CIGARETTE MAKERS

[75] Inventors: Marion A. Church, Newport News; Michael H. Dalton, Gloucester; Sherman C. Roane, Saluda, all of Va.

[73] Assignee: Philip Morris Incorporated, New York, N.Y.

[21] Appl. No.: 642,295

[22] Filed: Jan. 17, 1991

[51] Int. Cl.[5] ..... A24C 5/30; B26D 7/12

[52] U.S. Cl. ..... 83/174; 83/306; 83/327; 83/931; 51/247

[58] Field of Search ..... 83/174, 174.1, 411.4, 83/698, 700, 931, 306, 298, 327; 51/246, 247

[56] References Cited

U.S. PATENT DOCUMENTS

| | | | |
|---|---|---|---|
| 531,736 | 1/1895 | Munson | 131/65 |
| 585,002 | 5/1897 | Satterwhite | 131/65 |
| 639,677 | 12/1899 | Gilliland | 131/65 |
| 1,846,807 | 2/1932 | Hohn . | |
| 1,846,942 | 2/1932 | Bronander et al. | 146/101 |
| 1,888,774 | 11/1932 | Rundell | 51/247 |
| 1,933,785 | 11/1933 | Brandt | 51/247 |
| 1,972,442 | 9/1934 | Grupe | 131/65 |
| 2,207,433 | 7/1940 | Haswell | 51/247 |
| 2,886,083 | 5/1959 | Horgan | 146/101 |
| 3,168,848 | 2/1965 | Bardenhagen et al. | 83/174 |
| 3,169,431 | 2/1965 | Mason et al. | 83/356 |
| 3,241,413 | 3/1966 | Erdmann | 83/305 |
| 3,258,881 | 7/1966 | Mason et al. | 83/174 |
| 3,286,569 | 11/1966 | Hancock et al. | 83/174 |
| 3,532,015 | 10/1970 | Gianese | 83/174 |
| 3,753,379 | 8/1973 | Molins et al. | 83/174 |
| 4,090,424 | 5/1978 | Hall | 83/330 |
| 4,398,438 | 8/1983 | Seragnoli | 83/310 |

FOREIGN PATENT DOCUMENTS

| | | | |
|---|---|---|---|
| 1560068 | 7/1969 | Fed. Rep. of Germany . | |
| 2311505 | 4/1974 | Fed. Rep. of Germany . | |
| 2656003 | 10/1977 | Fed. Rep. of Germany . | |
| 612785 | 11/1948 | United Kingdom | 51/247 |
| 2098108 | 11/1982 | United Kingdom . | |

*Primary Examiner*—Hien H. Phan

*Attorney, Agent, or Firm*—Jeffrey H. Ingerman

[57] ABSTRACT

A method and apparatus for cutting a longitudinally advancing a rod of tobacco-containing material into lengths including a cut-off wheel having two or more blades equally spaced around the wheel periphery, a sharpening stone driven independently by a motor at a fixed location to sharpen one side of each blade as the wheel rotates, and a deburring stone oscillating in a path between two points at a frequency such that the stone intersects the path of travel of each blade for deburring the other side of each blade. The deburring stone may be located on the ledger device of a cigarette manufacturing machine where the ledger is oscillating at a frequency that is a multiple of the number of blades of the cutoff wheel for each revolution of the wheel.

15 Claims, 9 Drawing Sheets

APPARATUS AND METHODS FOR CUTTING RODS INTO LENGTHS FOR CIGARETTE MAKERS

BACKGROUND OF THE INVENTION

This invention relates to improvements in cutting a continuous rod of material into lengths, and more particularly to cutting an advancing cigarette rod into uniform lengths.

Commercial devices for forming cigarettes, filters for smoking articles, and similar products are known. These devices typically include a cut-off device for severing a continuous rod of advancing material into lengths. The lengths are then used to form the finished product, for example, cigarettes.

One such cut-off device is that found in a cigarette "maker" machine manufactured by Molins Limited, London, England, under the trade name models Mark 9Y or Mark 9-5. The cut-off device is located downstream of the point where the advancing cigarette rod is continuously formed and includes a rotating wheel including one knife blade, an oscillating ledger, a rotating sharpening stone, and an orbiting deburring stone. The wheel rotates in a first plane that is at an acute angle relative to the advancing rod. The knife is mounted on the wheel periphery so that the blade is fixed in a second plane at an angle to the first plane. The ledger device contains an aperture through which the tobacco rod advances and a slot that is perpendicular to the longitudinal axis of the rod and surrounds the aperture. The ledger device oscillates along the advancing rod in a timed relationship to the rotation of the cut-off wheel and the speed of the advancing tobacco rod.

In operation, for each revolution of the wheel, the knife blade edge is sharpened on one side, deburred on the other side, and passed through the ledger slot and the tobacco rod as the ledger is advancing with and at the same speed as the tobacco rod, thereby severing the tobacco rod. The blade edge is curved and the cutting point of the blade moves along the blade edge as the blade passes through the rod. Thus, as the blade passes through the slot, the cutting point moves in a plane normal to the axis of the rod and that normal plane advances with the rod at the same speed as the rod and the ledger. This forms a vertical cut in the rod.

The sharpening step involves passing one side of the blade cutting edge along the surface of a revolving sharpening stone. The stone is fixed in a position in the path of the knife blade and is driven by a series of gears, belts, and pulleys powered by the maker drive mechanism in a timed relationship to the speed of the rotating wheel.

The deburring step is accomplished by passing a deburring stone along the other side of the blade cutting edge. The deburring stone freely rotates about an axis and "precesses" in an orbit about a second axis. The deburring stone moves faster than the blade and its orbit intersects the plane of the rotating knife so that the deburring stone runs away from the knife blade in contact with and along the curved cutting edge of the blade.

The deburring stone orbit is controlled by a mechanical device referred to as the orbiter. The orbiter includes a series of gears, including very fine pitch gears, and belts, connected to the maker machine drive. Thus, the orbit of the deburring stone is mechanically linked to the rotation of the cut-off wheel for deburring the other side of the blade cutting edge on each revolution.

The angular relationship of the knife blade cutting edge relative to the axis of the cigarette rod may be adjusted to cut the rod into different size lengths. Typically, the positions of the sharpening stone and the deburring stone must be moved as the plane in which the cut-off wheel rotates and the plane in which the is blade fixed relative to the wheel are adjusted for cutting different lengths.

These cut-off devices are capable of producing as many as 5,000 cigarette lengths per minute. However, these devices suffer from a wide variety of problems that require shutting down the cigarette maker machine to correct. This entails substantial amounts of down time not only to repair problems as they occur, but to restart the cigarette maker machine. The latter step involves substantial wastage of time, tobacco and cigarette paper as the maker machine must be cleaned, rethreaded with paper, and restarted to form the tobacco rod before production of cigarettes can resume. In addition, these machines are typically operated at a speed that is less than capacity because of the level of vibrations and wear experienced when operated at maximum speed.

One problem with the prior known devices is that the orbital devices are mechanically complicated, leak oil, generate heat, and introduce vibrations in the cigarette maker machine. In addition, the orbit must be carefully adjusted to the movement of the blade to effect the deburring operation. This process is difficult and requires significant amounts of time.

Further, during the cutting operation, substantial amounts of tobacco dust are generated and accumulate on the oil that has leaked on and around the orbiter mechanism. It is not unknown for fires to start in the cut-off device as a consequence of the accumulated oil and tobacco particles being ignited by heat or sparks caused by the sharpening or deburring operations. Also, the oscillatory nature of the orbiter, and its drive mechanism connected to the machine drive, introduce substantial vibrations that accelerate wear of the various moving parts.

Another problem with the known devices is that they are not readily adaptable to providing cut-off wheels with more than one blade. In particular, the orbital device would have to be regeared to obtain an orbital speed that will contact and debur each blade, thus introducing additional heat, lubrication and vibration problems.

Another problem with the prior known devices is that the sharpening stone is driven by belts and pulleys from the machine drive. Thus, the speed at which the stone rotates is controlled by the operating speed of the machine, and can be otherwise changed only by altering the gear ratios. Further, the belt and pulley drive mechanism introduces an added source of heat, wear, and potential breakage requiring shutting down the machine for service.

Accordingly, there is a continuing need for improvements in the construction and operation of devices for cutting continuously advancing rods into uniform lengths that improve the reliability, serviceability, and performance of such devices.

It is, therefore, an object of this invention to provide a sharpening stone that is independently driven for sharpening one side of each knife blade on each revolution of the blade. It is another object to provide a sharpening stone drive mechanism that is decoupled from the maker and requires minimal service.

It is another object of this invention to provide a method and apparatus for deburring a rotating knife blade without using a mechanically complicated orbital deburring device. It is another object to provide a deburring device that uses a minimum number of moving parts. It is another object to provide a deburring device that is simple to adjust. It is another object to provide a deburring device that can debur more than one knife blade. It is another object to provide a deburring device that is decoupled from the angle of travel of the knife blade.

It is another object of this invention to reduce substantially the number of mechanical parts and interconnections in the cutoff device of a cigarette maker machine. It is another object to provide a cut-off device having reduced wear and maintenance problems.

It is another object of this invention to modify a conventional cigarette maker machine and provide a cutoff device with a cutoff wheel having a plurality of blades. It is another object to provide a cutoff wheel having a plurality of knife blades that are sharpened on one side and deburred on the other side during each revolution. It is another object to provide a cutoff wheel having a plurality of blades that operates at a slower speed with fewer vibrations while maintaining the same production rate to extend the machine lifetime between service. It is another object to provide a cut-off wheel having a plurality of blades that does not require regearing of a deburring orbital device.

SUMMARY OF THE INVENTION

In accordance with the present invention, an improved cut-off device for severing a continuously advancing rod of tobacco-containing material is provided. Broadly, the invention concerns a cut-off device having a sharpening stone driven by an electric motor independent of the maker drive mechanism, a deburring stone secured to the oscillating ledger and disposed proximate to the ledger slot, and a cut-off wheel having a plurality of blades so that each blade is sharpened on one side, deburred on the other side, and passed through the ledger slot to sever the advancing rod of material.

One embodiment of the invention is directed towards an apparatus for cutting a longitudinal rod of tobacco-containing material advancing at a first speed in a first direction into lengths. Such an apparatus includes:

(a) a wheel having a knife means including a blade with a first side and a second side forming a cutting edge for severing the tobacco-containing rod;

(b) means for rotating the wheel at a first rate so that the blade has a first path of travel and the blade cutting edge passes through the rod to sever the rod into lengths;

(c) a sharpening stone surface;

(d) means for rotating the sharpening stone surface at a second rate which is independent of the first rate and the first speed;

(e) means for positioning the sharpening stone surface in the path of travel of the blade so that one of the first or second sides of the blade passes along the rotating sharpening stone surface to sharpen the cutting edge;

(f) a deburring stone surface; and (g) means for oscillating the deburring stone surface in a second path between a first location and a second location at a frequency wherein the second path intersects the first path so that the other of the first or second sides of the blade passes along the deburring stone surface to debur the cutting edge.

In an alternate embodiment, wheel (a) further comprises a first knife and a second knife, the first and second knives being mounted in opposition on the wheel, and the oscillating means (g) oscillates with a frequency so that the other side of each blade passes along the deburring store surface. In yet another embodiment, wheel (a) comprises more than two knives and each knife is mounted equidistant about the wheel and the oscillating means (g) oscillates with a frequency so that the other side of each blade passes along the deburring stone surface.

Each knife means preferably comprises a blade, a housing for the blade, a threaded rod mounted for rotation in the housing, a slide threadably mounted on the threaded rod for movement therealong and secured to the blade, whereby rotating the rod moves the slide and the blade relative to the rod and the housing, and a ratchet wheel secured to the threaded rod for rotation with the rod. Accordingly, for a wheel having two knife means, the wheel further comprises a rod having a first pawl and a second pawl for respectively engaging the ratchet wheel associated with each knife means and an actuator means for moving the rod intermittently to engage the first and second pawls with the first and second ratchet wheels to rotate the first and second threaded rods to move the first and second blades a selected distance. Thus, the blades may be advanced intermittently following a preselected number of sharpenings.

In a preferred embodiment, the wheel is rotated in the range of 2,500 to 3,400 rpm, the actuator means intermittently advances the rod a distance of, for example, 0.01 mm in the range of once every 30 to 45 seconds.

Each blade may have a thickness selected from among the range of 0.02 to 0.03 mm wherein the cutting edge further comprises a beveled edge wherein the first side is at an angle selected from the range of 14° to 16° relative to the second side, more preferably 15°, the second side being a flat side of the blade. Each blade further comprises a leading edge and a trailing edge, the cutting edge further comprises a radius such that the leading edge is shorter than the trailing edge by an amount sufficient to sever the rod.

In the preferred embodiment, the means for rotating the sharpening stone is an electric motor selected to rotate at the rate of 3,400 to 3,600 rpm. More preferably, the motor operates at a faster speed than the wheel by about 10 to 15%. The motor is secured to a bracket for holding the motor in a position relative to the wheel and includes a means for adjusting the angle of the motor axis relative to the axis of rotation of the wheel. The angle adjusting means is preferably interposed between the bracket and the motor and means for moving the motor along its axis of rotation relative to said adjusting means. This provides for properly orienting the sharpening stone for sharpening each blade.

One embodiment of the present invention is directed towards the deburring stone surface being a cylinder having a longitudinal axis that is maintained perpendicular to the longitude of the rod. It is positioned to oscillate relative to the path of travel of each blade so that the leading edge engages the cylinder proximate one end of its length, the side of the cutting edge to be deburred travels along the cylinder length, and the trailing edge disengages the stone proximate the other end of the cylinder length. The blade may contact the cylinder tangentially, with sufficient force to debur the sharpened edge. The deburring stone is preferably attached to a spindle and is freely rotatable about the spindle.

In a preferred embodiment, the deburring stone is mounted on a conventional ledger having an aperture for passing therethrough the longitudinal advancing rod, a slot perpendicular to the aperture, and a pivot point. The ledger oscillation frequency is timed to the first rate so that as the wheel rotates, each blade cutting edge passes through the aperture to sever the rod, and the deburring stone surface is disposed proximate to the slot so that, as the wheel rotates, each blade cutting edge passes along the deburring stone surface prior to passing through the slot. In accordance with this embodiment, the deburring stone moves in path that is generally perpendicular to the path of the rotating blade.

Another embodiment of the invention is directed towards a method for severing a rod of continuously advancing tobacco-containing material into lengths. One such method comprises:

(a) providing a wheel having a first knife and a second knife mounted in opposition about the wheel, each knife having a blade with a cutting edge having a first side and a second side;

(b) providing a sharpening stone for sharpening one of the first or second sides of each blade cutting edge;

(c) rotating the sharpening stone at a first rate;

(d) providing a deburring stone for deburring the other of the first or second sides of each blade cutting edge;

(e) oscillating the deburring stone back and forth between a second fixed position and a third fixed position defining a path; and (f) rotating the wheel at a second rate, independent of the first rate, so that, for each blade, one side of the cutting edge passes along the rotating sharpening stone at the first location, the other side of the cutting edge passes along the oscillating deburring stone surface, and the sharpened and deburred cutting edge passes through the rod.

In one embodiment, the first rate is in the range of from 3,400 to 3,600 rpm, and the second rate selected in the range from 2,500 to 3,400 rpm more preferably from 3,160 to 3,340 rpm.

In a preferred embodiment, the step of oscillating the deburring surface (e) comprises (g) providing a ledger having an aperture, a slot, and a pivot point;

(h) moving the ledger about its pivot point through a range of motion at a frequency and passing the tobacco containing rod though the aperture; and (i) securing the deburring stone to the ledger proximate to the slot wherein rotating the wheel further comprises selecting the second rate and frequency so that each blade cutting edge passes through the oscillating ledger slot following passing along the deburring stone surface.

Yet another aspect of the invention is directed toward improvements to a conventional cigarette manufacturing machine having a continuously formed, advancing rod of tobacco containing material, a ledger oscillating at a first frequency having an aperture through which the advancing rod passes, a wheel rotating at a first rate having a knife blade passing through the aperture slot severing the rod into lengths, a sharpening stone for sharpening one side of the blade, and a deburring stone for deburring the other side of the blade. In this embodiment, the improvement comprises:

(a) a second knife mounted on the wheel in balanced opposition to the first knife;

(b) means for rotating the sharpening stone at a second rate independent of the first rate in a fixed position;

(c) a cylindrical deburring stone surface having a length and a longitude;

(d) means for securing the deburring stone to the ledger proximate to the slot so that the cylindrical length is perpendicular to the advancing rod and one side of each blade passes along the cylindrical surface longitude prior to passing through the slot; and (e) means for oscillating the ledger at twice the first frequency so that each knife blade passes through the ledger slot to sever the rod.

In one embodiment, the improvement also comprises (f) means for intermittently advancing the first and second blades outwardly simultaneously as the blades become worn.

Another aspect of the present invention is directed toward an apparatus for deburring a rotating blade for severing a tobacco containing rod into lengths. One such apparatus comprises a deburring stone having a cylindrical surface and means for oscillating the deburring stone in a path between a first location and a second location at a frequency so that the path intersects the rotating blade and one side of the blade contacts and passes along the cylindrical length.

In a preferred embodiment, the deburring stone has a spindle and means for mounting the spindle so that the cylindrical surface may rotate when contacted by the one side of the blade. More preferably, the spindle is mounted in a housing attached to the conventional oscillating ledger having a pivot point and a slot so that the cylindrical surface is maintained horizontal and perpendicular to the tobacco-containing rod and proximate to the slot. Thus, the first path of the deburring stone is in two dimensions. The cylinder may be maintained horizontal and parallel to the advancing tobacco-containing rod. Further, the path may be curved so that the cylinder travels in an arc.

In a preferred embodiment, the housing is secured to the ledger by a flange having an elongated slot oriented parallel to the tobacco containing rod and bolts to permit adjusting the location of the cylindrical stone relative to the blade path.

Another embodiment of this aspect of the invention is directed toward a method for deburring a blade attached to a cut-off wheel used for severing advancing tobacco-containing rods into length. One such method comprises (a) rotating the cut-off wheel at a first rate;

(b) providing a deburring stone with a cylindrical surface having a length and an axis;

(c) mounting the stone in a housing so that the stone freely rotates about its axis and its axis is perpendicular to the advancing tobacco-containing rod; and (d) oscillating the housing at a second rate so that the stone travels in a path between two points parallel to the advancing rod that intersects the path of travel of the cut-off wheel blade so that the one side of the blade contacts and passes along the cylindrical length. Preferably, mounting the stone maintains the stone axis horizontal to the advancing tobacco rod, and oscilling the housing further comprises securing the housing to a conventional oscillating ledger whereby one side of the blade passes along the cylindrical surface prior to passing through the ledger aperture to sever the rod.

Another aspect of the present invention is directed toward a method for manually adjusting the position of a cylindrical deburring stone releasably secured to an oscillating ledger for deburring one side of a knife blade having a radius cutting edge including a leading edge, a trailing edge, and an edge center between the leading and training edges, wherein the blade is secured to a rotatable wheel at an angle relative to the plane of rotation of the wheel. One such method comprises:

(a) positioning the blade to extend a selected length from the wheel periphery;

(b) rotating the wheel so that the edge center is horizontally aligned with the midpoint of the cylindrical deburring stone;

(c) moving the deburring stone in the horizontal plane so that the edge center barely contacts the deburring stone surface;

(d) securing the deburring store in place in contact with the edge center;

(e) rotating the wheel to place the leading edge of the blade horizontally aligned with the deburring stone and confirming that the leading edge is not in contact with the blade;

(f) rotating the wheel to place the trailing edge of the blade horizontally aligned with the deburring stone and confirming that the trailing edge is more in contact with the deburring stone than the center edge; and (g) readjusting the deburring stone or the knife blade if the leading edge is in contact with the stone or the trailing edge is not in contact with the stone on manual rotation.

A wheel having more than one blade can be adjusted by following this procedure on one blade, and then confirming that the other blade or blades satisfy the steps (b), (e) and (f) and, if necessary, step (g).

Advantageously, the present invention provides a more reliable cut-off device that does not suffer from the problems of vibration, heat generation, mechanical breakdown, complicated readjustment procedures, and oil leakage associated with an orbiting deburring stone, or the breakdown problems associated with a sharpening stone mechanically driven by the maker motor. Further, the improved device is more balanced and operates at a lower speed with fewer mechanical parts, thus generating less heat and fewer vibrations and using less cooling oil, and having fewer sources of breakdown. Also, the improved machine has fewer moving parts and thus fewer parts to repair or replace, requires a smaller spare parts inventory, and is easier to adjust and to be brought back to operating condition quickly. In addition, the device of the present invention is able to operate at half the speed of the prior devices yet achieves more than 100% of the efficiency rate of that machine, at substantial improvements in downtime, operating expenses and labor for repair, readjustment and restarting the improved machine.

BRIEF DESCRIPTION OF THE DRAWINGS

Further features of the invention, its nature and various advantages will be more apparent from the accompanying drawings and the following detailed description of the invention, in which like reference numerals refer to like elements, and in which.

DETAILED DESCRIPTION OF THE INVENTION

Figure 1:
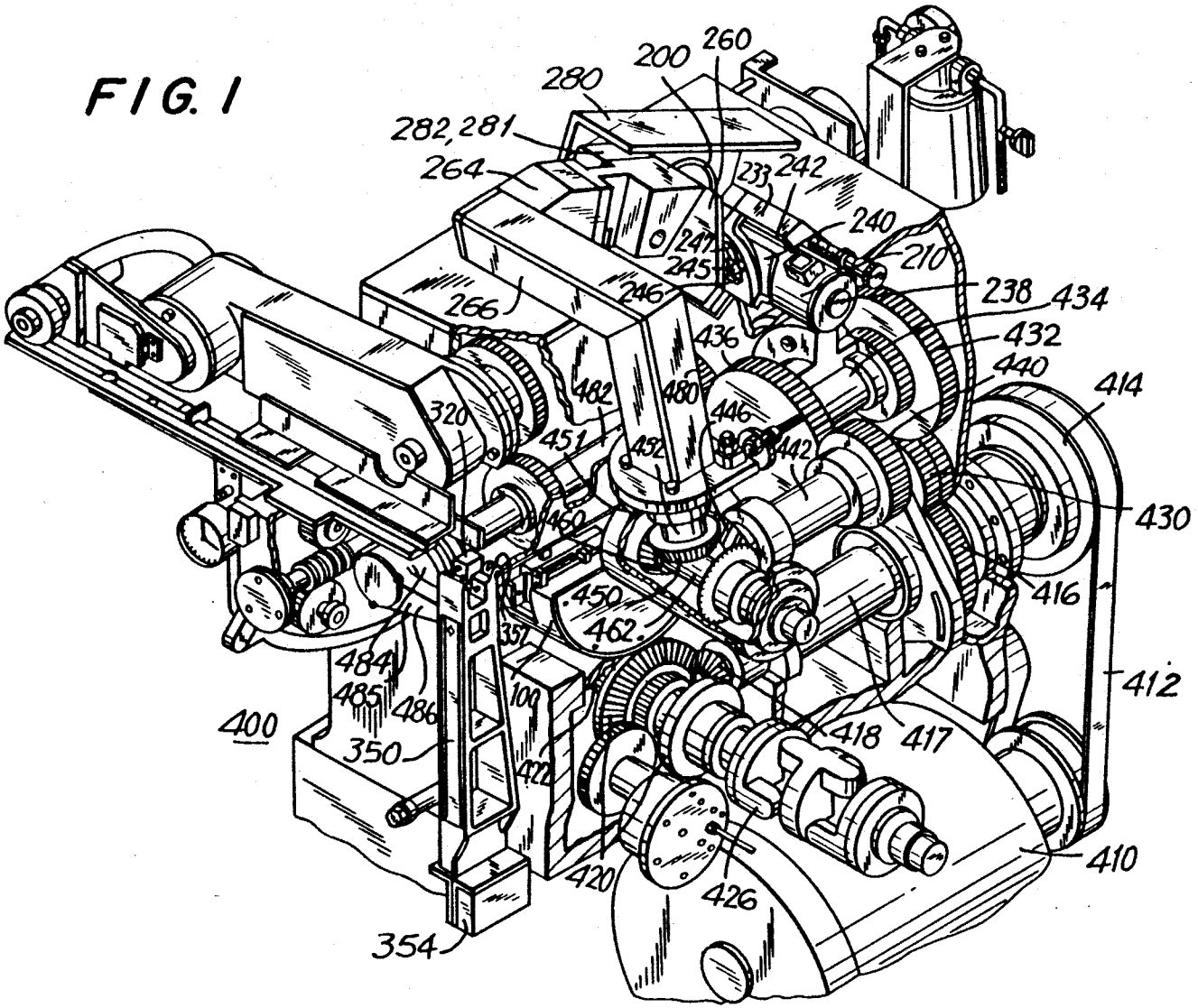
FIG. 1 is an elevated perspective view of a cut-off device of an embodiment of the present invention.

Various aspects of the present invention are shown in FIGS. 1 and 3-11. Referring to FIG. 1 and 3-11, an embodiment of the present invention includes a cut-off wheel 100, a sharpening stone 200, and a deburring stone 300. Also shown in FIG. 1 are the portions of a commercial cigarette maker machine 400, specifically a Molins model Mark 9Y or Mark 9-5 cigarette maker machine, which, although not forming a part of the present invention (except as stated herein) is associated with the cut-off device of the present invention and is described for the sake of completeness.

Figure 2:
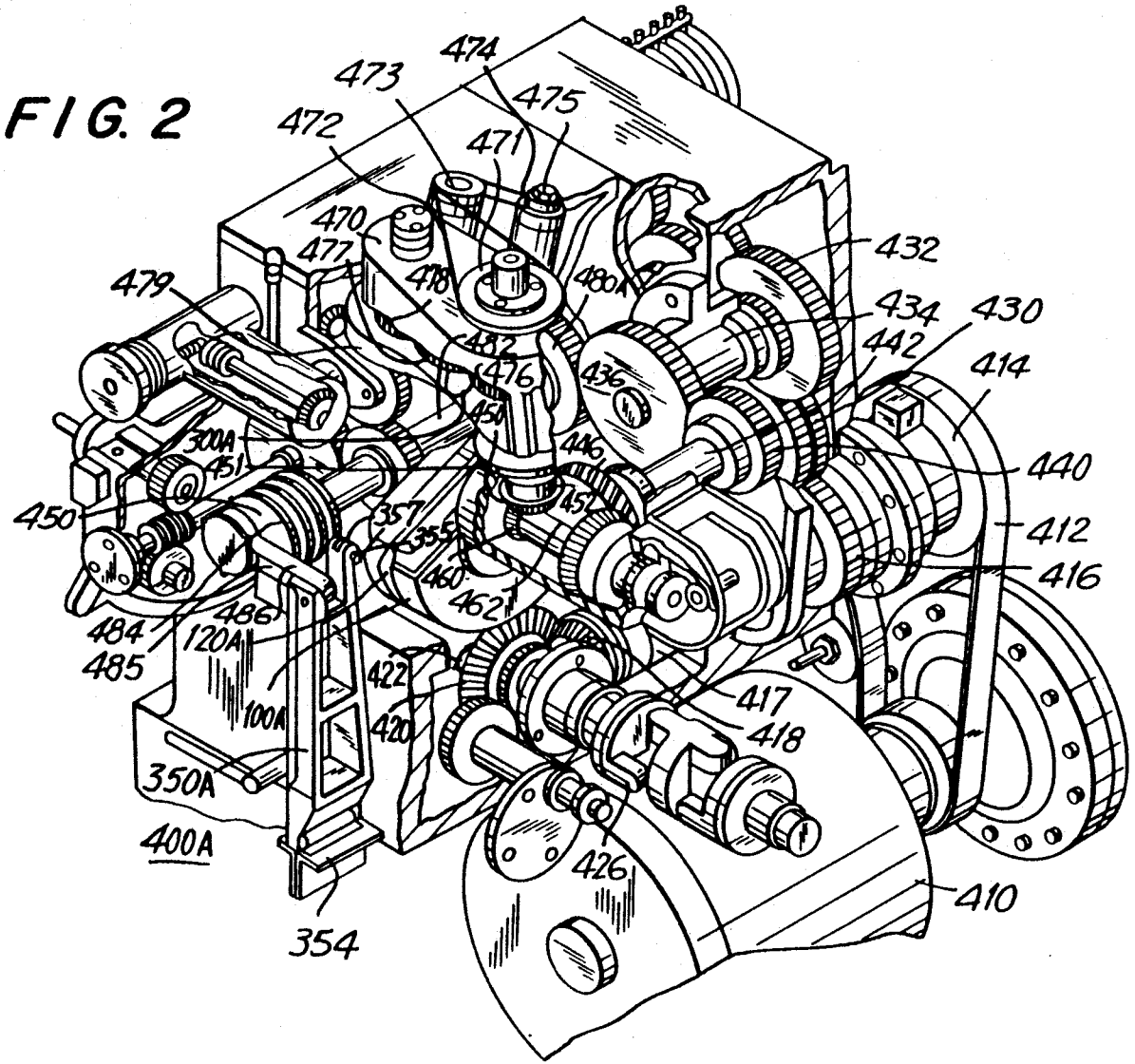
FIG. 2 is an elevated perspective view of a cut-off device in accordance with the prior art.

Referring to FIG. 2, pertinent portions of a commercial Molins Mark 9Y or Mark 9-5 machine 400A is shown to provide a comparison between the prior art device and the present invention. In describing the prior art device, the suffix "A" following a reference numeral in FIG. 2 indicates that the element associated with that reference numeral depicted in FIG. 2 is the existing commercial device element, whereas the absence of the suffix A for that reference numeral depicted in FIG. 1 indicates that the commercial element has been modified for use with or as a part of the present invention. The absence of the suffix "A" for a reference numeral in FIG. 2 indicates that that portion of the prior machine is not modified for use with or as a part of the present invention.

Referring to FIGS. 1 and 2, maker 400 and maker 400A commonly include motor 41 which drives belt 412 around pulley 414 to rotate gears 416 and 418 on shaft 417 to provide power to drive various portions of maker 400. Gear 418 engages gears 420 and rotates shaft 422 which drives filter tipper drive 424 and universal joints 426 to drive the tape drum gearbox of the conventional maker machine. Gear 416 engages gear 430 which meshes with gear 432. Gear 432 drives shaft 434 and gear 436. Gear 436 meshes with gear 440 which rotates shaft 442 and gear 446 secured to shaft 442. Gear 446 in turn engages gears 450, 460 and 460' which rotate shafts 452 and 462. Shaft 462 and 452 and gears 446, 450, 460 and 460' are positioned within housing 451. Housing 451 is adapted to move whenever wheel 100A is angularly adjusted so that shaft 462 remains perpendicular to the plane of rotation wheel 100A.

Referring to FIG. 2, shaft 462 is secured to cut-off wheel 100A having knife 120A to rotate wheel 100A in timed relationship to the speed of the advancing rod of tobacco (not shown). Orbiter 470 is mounted to housing 451 and includes a shaft (not shown) that is coupled at one end to the end of shaft 452 and at the other end has pulley 471. Pulley 471 drives belt 472, which passes over capstans 473 to drive pulley 474 secured to one end of shaft 475. At the other end of shaft 475 is a sharpening stone (not shown in FIG. 2) similar to sharpening stone 200 of FIG. 1, which is thus driven in a timed relationship to the speed of cut-off wheel 100A by belt 472.

Also mounted on the shaft not shown is gear 476 which engages gear 477 which in turn engages gear 478. Gear 478 is in turn secured to an eccentric 479 to which the deburring stone 300A is attached. Thus, when cut-off wheel 100A is rotating, deburring stone 300A passes through an orbit in a timed relationship to knife blade 120A to contact and move along one side of the moving blade to debur that one side.

Also referring to FIG. 2, gear 436 drives gear 480A which is secured to shaft 482. At one end of shaft 482 is fitting 484. Eccentrically mounted to fitting 484 is shaft 485 of piston 486. Thus, shaft 482 acts as a crankshaft to drive piston 486 through a stroke having a range of 16 to 25.5 mm depending on the rod length selected. Piston 486 is connected at the other end to ledger 350A for oscillating ledger 350A about its base 354 in a timed relationship to the speed of cut-off wheel 100A so that ledger 350A oscillates one period for each revolution of wheel 100A. Ledger 350A includes aperture 355 through which the continuously advancing rod is passed, and slot 357 through which knife 120A passes to sever the advancing rod.

Referring now to FIG. 1 and 3–11, and to the present invention, shaft 462 is secured to cut-off wheel 100 having two knives 120, arranged in opposition on the perimeter of wheel 100, and rotates wheel 100 in a timed relationship to the speed of the advancing rod of tobacco (not shown) to sever the rod into uniform lengths. In accordance with the present invention, shaft 452 is not coupled to any item and is permitted to rotate freely, essentially unloaded Gear 436 is engaged to gear 480 which is secured to shaft 482. Shaft 482 has a one end fitting 484 to which is eccentrically mounted piston 486 for oscillating ledger 350 in a timed relationship to the speed of wheel 100. Ledger 350 pivots about base 354 and is approximately 30 cm long so that the arc of travel of ledger 350 is sufficiently large that it will not bind the advancing rod.

In the preferred embodiment, the gears 436 and 480 are configured so that ledger 350 undergoes two oscillations for each revolution of cut-off wheel 100 having two diametrically opposed cut-off knives 120. Thus, each knife blade 120 will pass through slot 357 as ledger 350 is moving in the same direction and at the same speed as the advancing rod. For cut-off wheels having additional blades, appropriate adjustments in the gear ratios should be made so that ledger 350 oscillates with a frequency that permits each blade 120 to pass through slot 357 to sever the tobacco rod into uniform lengths.

Figure 3:
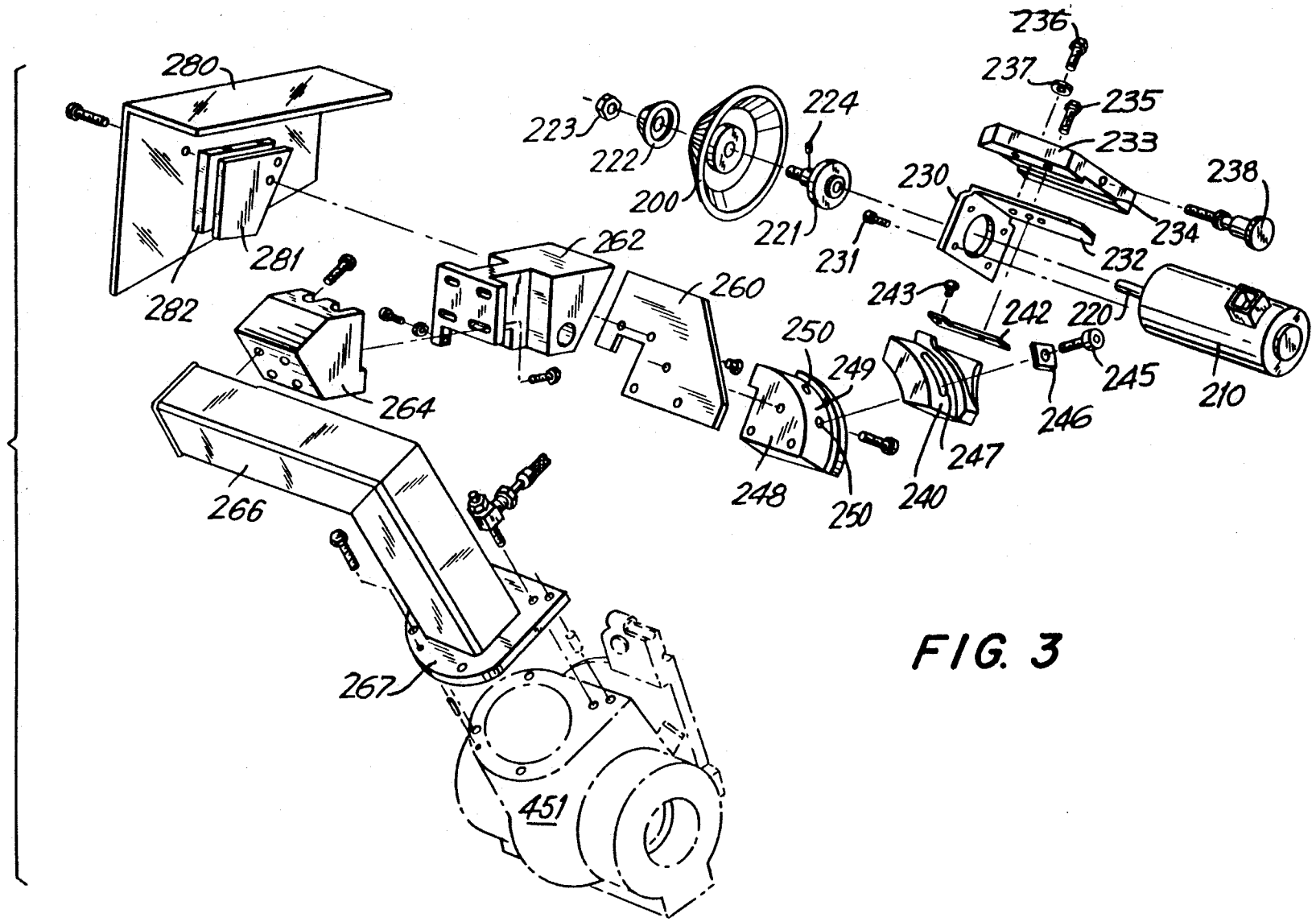
FIG. 3 is an exploded perspective view of the sharpening stone drive assembly of FIG. 1.
Figure 4:
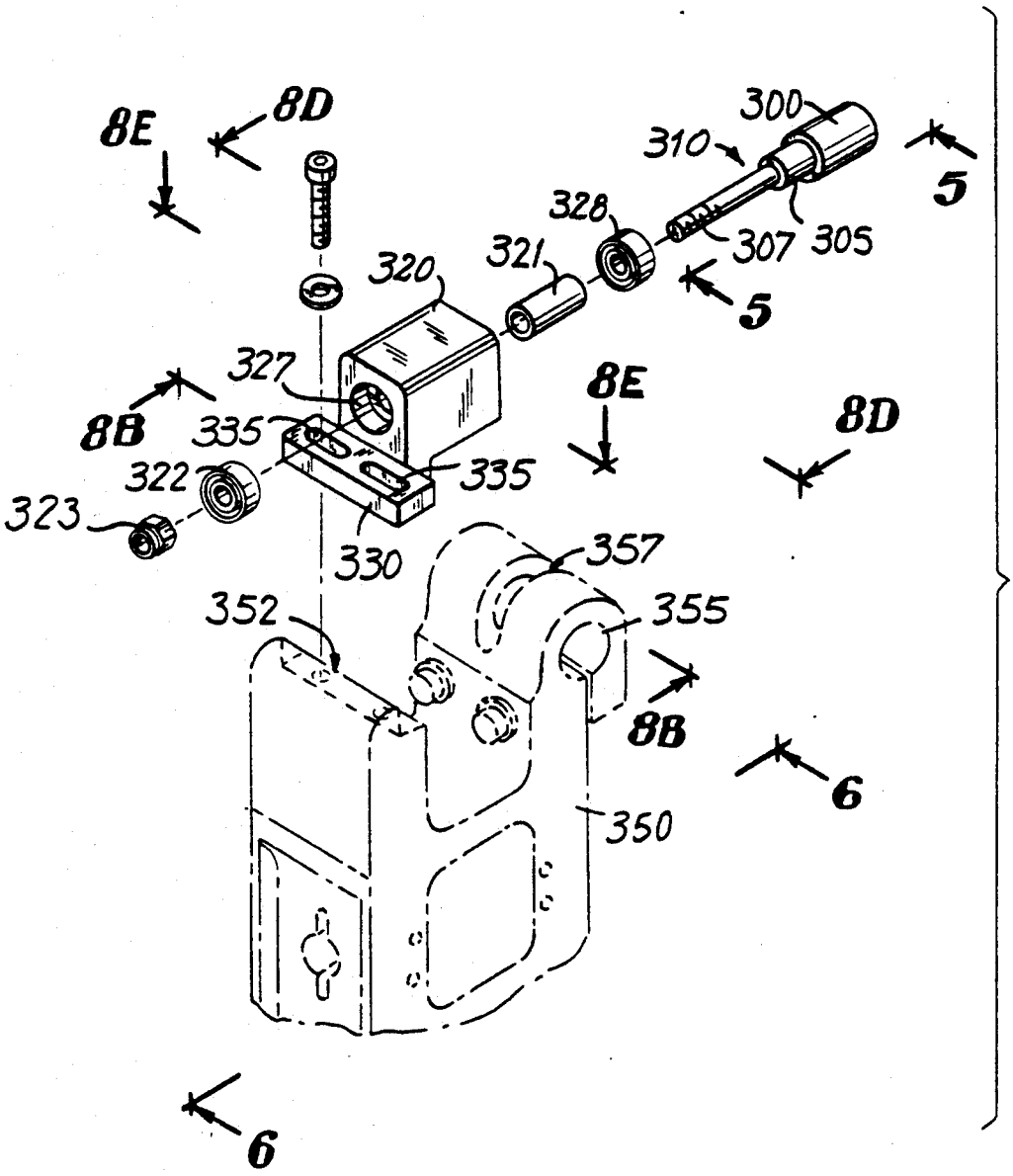
FIG. 4 is an exploded perspective view of the deburring stone assembly of FIG. 1.
Figure 5:
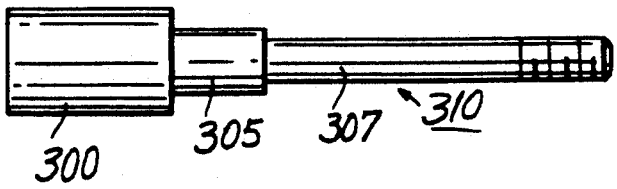
FIG. 5 is a side sectional view taken along line 5—5 of FIG. 4.

Referring to FIGS. 1 and 3, the cut-off device of the present invention includes sharpening stone 200 which is secured to shaft 220 of motor 210 by flanged threaded bushing 221, cap 222, and nut 223. Flanged bushing 221 is secured to shaft 220 by set screw 224. Sharpening stone 200 is preferably made of CBNE-E-Process, available from Norton Industries, and has a contoured surface so that the point of the contact between the blade edge and the stone changes as the blade edge moves along the stone surface. Motor 210 is preferably a controllable speed motor capable of operating at speeds of 3,400 to 3,600 rpm, preferably at about 3,500 rpm. One useful motor is model NECKAR-MOTOREN, S.N. A17655 manufactured by Hauni, Part Number 1998277-EA6010.

Motor 210 is mounted to bracket 230 by screws 231. Bracket 230 has plate 232 which is configured to fit into a cutout portion or receptacle 234 of plate 233.

Plate 233 includes a longitudinally extending aperture (not shown) that is parallel to cutout portion 234 which is for translating plate 232 of bracket 230 relative to plate 233 along that longitude. Plate 232 is secured to screw 236 which is prevented from passing through the longitudinal aperture by washer 237. Thumbscrew 238 is provided for securing bracket 230 to plate 233. This for setting the position of sharpening stone 200 relative to the path of blades 100 for sharpening one side of each blade.

Plate 233 is connected to slide 240 which is in turn slidably secured to bearing 248 so that the angle of motor 210 relative to vertical can be adjusted and fixed. This is important for severing different lengths of cigarette rod because different lengths require a different plane of rotation for cut-off wheel 100 and, separately, a different angle for mounting blades 120 to wheel 100. Motor 210 must be similarly repositioned to intersect the new blade path for sharpening each blade.

Plate 233 is secured to bracket 242 by screw 235 and bracket 242 is in turn secured to slide 240 by screw 243. Slide 240 has a longitudinally extending aperture 247 and a curved surface that mates with surface 249 of bearing 248. Slide 240 is thus positioned along surface 249 so that motor 210 and sharpening stone 200 can be placed in the desired angular orientation and secured to bearing 248 by screw 245 and washer 246 which interconnects with one of threaded holes 250. Aperture 247 provides a reasonable range of motion for slide 240. More than one threaded hole 250 may be provided to accommodate a range beyond the size of aperture 247. Thus, screw 245 does not need to be reset to a different hole 250 unless a substantial change in position is required.

Motor 210 is located in a position that is convenient for placing sharpening stone 200 in the path of blades 120, preferably at about the location of the shaping stone of the prior art machine. In the preferred embodiment, bearing 248 is secured to plate 260, which is secured to an angled fixture 262, which is secured to a second fixture 264, which is secured to right angle member 266 which has flange 267. Flange 267 is desirably secured to housing 451 at the location where orbiter 470 of the commercial device was removed. Housing 451 provides a convenient location capable of supporting the weight of orbiter 470 and thus of the members 266, 264, 262 and motor 210 of the present invention. In addition, housing 451 surrounds shaft 462 and will move as the angle of cut-off wheel 100 is adjusted for cutting different length rods. This point of connection thus minimizes the repositioning of motor 210 for cutting different length rods.

Also connected to fixture 262 is shield 280 through plates 281 and 282. Shield 280 is preferably a plexiglass TM or other clear plastic material intended to confine sparks generated during sharpening or deburring and to protect the operator from parts that may break off or come loose during the operation of or during maintenance on maker machine 400. Thus, whenever the angular position of wheel 100 is changed, the entire assembly supporting motor 210 also moves accordingly.

Sharpening stone 200 is adjusted relative to knife 120 as follows. The angle of the sharpening wheel assembly is adjusted to match the angle of wheel 100 at slide 240. Stone 200 is aligned with the leading edge of the knife. Once stone 200 touches the leading edge, the trailing edge of blade 120 also must be at the correct angle for sharpening. When this is achieved, screw 238 is tightened to minimize any play in blade 120. Thereafter, plate 233 is loosened and screw 238 is loosened one half revolution. This last adjustment controls the height of blade 120 relative to stone 200 for the sharpening operation.

Referring to FIGS. 1 and 4–8, in accordance with an embodiment of the present invention, deburring stone 300 is shown. Deburring stone 300 is mounted on shaft 310 which has a large diameter portion 305 which acts as a spacer member for positioning stone 300 in the proper location relative to slot 357 of ledger 350 as described below.

Shaft 310 is mounted in housing 320 for free rotation. Bearing 328 and spacer 321 are threaded about shaft 310 so that bearing 328 is captured between housing 320 and large diameter portion 305 of shaft 310. Shaft 310 is provided with a threaded end 307 and nut 323 is secured to threaded portion 307 so that bearing 322 is threaded about shaft 310 and captured between nut 323 and housing 320. Thus, shaft 310 will rotate within housing 320 on bearings 328 and 322. Housing 320 has milled out portions 325 for receiving bearing 328, 326 for receiving spacer 321, and 327 for receiving bearing 322.

Housing 320 also includes flange 330 having a pair of apertures 335. Apertures 335 provide for mounting flange 330 to ledger 350 at area 352 so that housing 320 may be adjustably positioned along the longitudinal axis of the advancing rod and so that stone 300 is disposed adjacent the path of blades 120 of wheel 100. This provides for adjusting the position of deburring stone 300 when the angles of wheel 100 is and blade 120 are adjusted for cutting different length sections of rod.

Importantly, the dimensions of housing 320, and shaft 310 are selected so that stone 300 is positioned to intercept tangentially flat edge 124 (see FIG. 11B) immediately prior to blade 120 entering slot 357 to sever the advancing rod.

Adjustment of deburring stone 300 is as follows: The center of blade 120 is lined up with the center of shaft 310. Housing 320 flange 330 is loosened and the housing is adjusted relative to ledger 350 area 352 so that knife blade 120 just barely touches stone 300 in the center of the blade. Housing 320 is then resecured to area 352 at flange 330. When deburring stone 300 is correctly positioned and wheel 100 is turned by hand, stone 300 will not contact the leading edge of blade 120, will barely contact the middle of blade 120, and will contact more of the trailing edge of blade 120. In operation at higher rpms, blade 120 will deflect somewhat due to its angle of attack relative to the axis of wheel 100 and air resistance and contact with deburring stone 300 will become relatively uniform along the blade edge. If more than one blade is on a wheel, the adjustments are made for one blade and then checked for the other blade. If both blades do not have the same proportional contact along their edges, one or more of the blades is adjusted relative to the wheel and the deburring stone is again adjusted as described above.

In a preferred embodiment, stone 300 may be a steel cylinder having a diameter of 9.5 mm and a length of 16 mm, for example, 4140 HRS, that is coated with an abrasive material, for example, a plating of Norton Industries CBNE-E-PROCESS.

Figure 6:
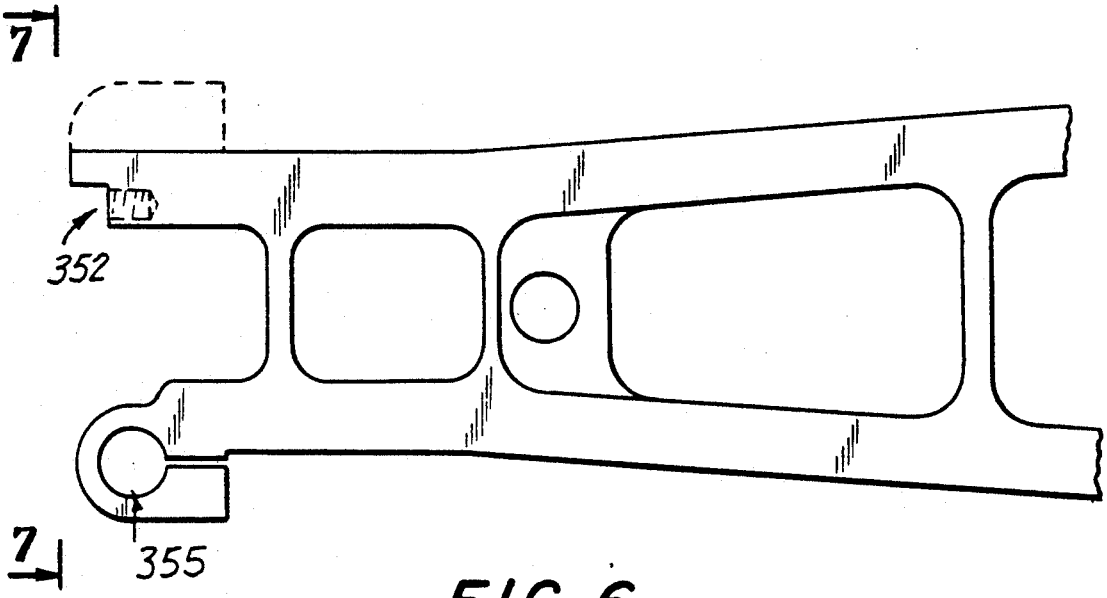
FIG. 6 is a side view taken along line 6—6 of FIG. 4.
Figure 7:
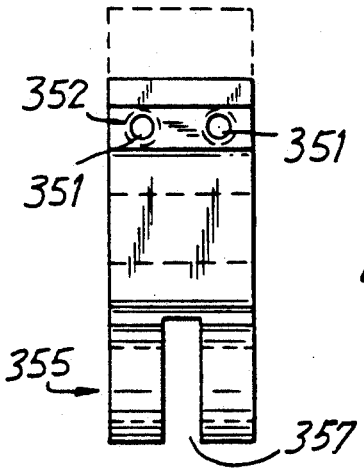
FIG. 7 is a top view taken along line 7—7 of FIG. 6.
Figure 8A:
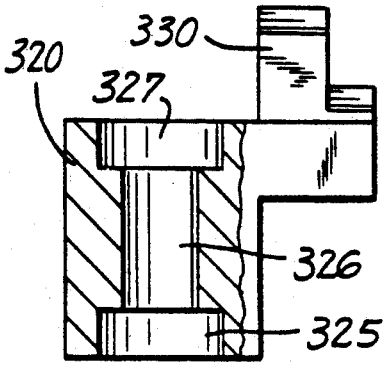
FIGS. 8A, 8B, 8C, 8D, and 8E are views of the deburring stone housing of FIG. 4.
Figure 8B:
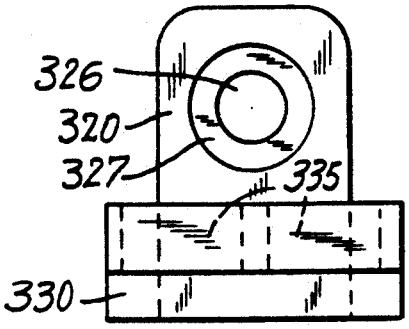
Figure 8C:
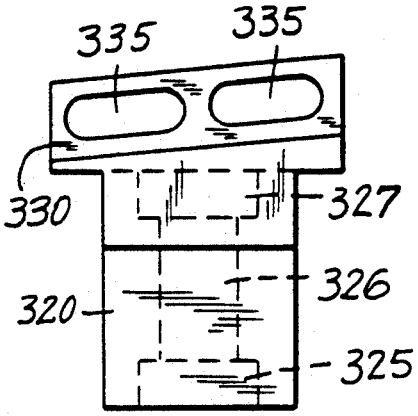
Figure 8D:
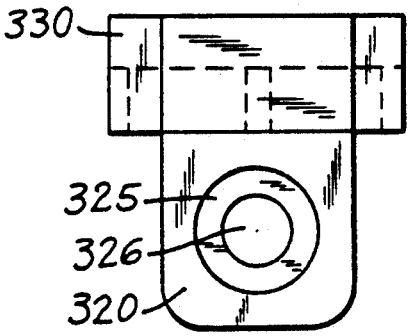
Figure 8E:
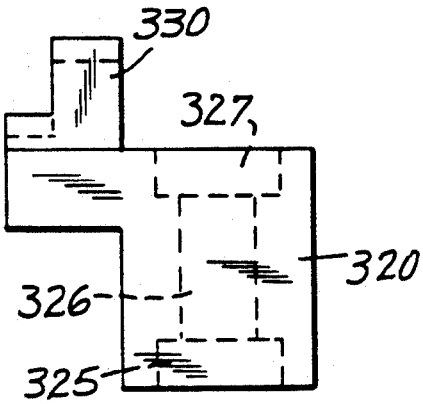

Referring to FIGS. 6 and 7, a conventional ledger 350 is shown as provided with a commercial Molins Mark 9Y Maker machine (see ledger 350A of FIG. 2). In accordance with the present invention, area 352 of ledger 350 is modified by removing the portions indicated in phantom lines and providing threaded apertures 351 to receive bolts to secure flange 330 of housing 320.

Referring to FIGS. 1 and 9–11, an embodiment of cutoff wheel 100 in accordance with the present invention is shown. Wheel 100 may be a conventional cut-off wheel (e.g, wheel 100A as supplied with conventional maker machine 400A of FIG. 2) modified for receiving additional knife blades 120 and corresponding knife blade advancement mechanisms as described below. Wheel 100 is a multicomponent assembly including disk 102, front plate 104, back plate 106, two knife assemblies 130 that have the same construction, pawl mechanism 140, and cover plate 126.

Figure 9:
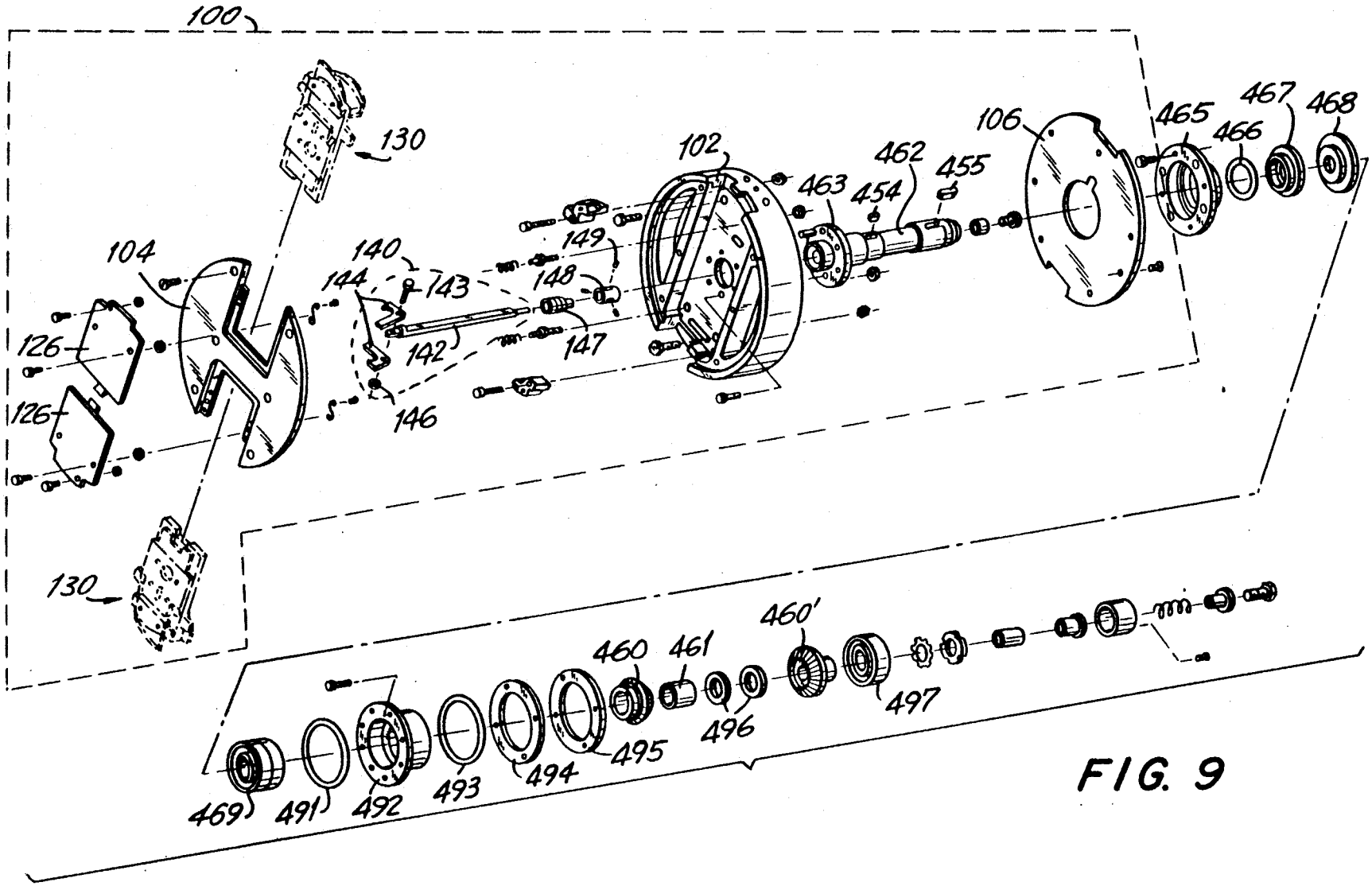
FIG. 9 is an exploded perspective view of the cut-off wheel of FIG. 1.

Referring to FIGS. 1 and 9, wheel 100 is secured to shaft 462 by flange 463 as in a conventional Molins Mark 9Y. Thus, back plate 106 is secured to disk 102, and connected, in order, to flange 465, bushing 466, flinger 467, nilos ring 468, bearing 469, bushing 491, flange 492, bushing 493, gaskets 494 and 495, gear 469, spacer 461, washers 496, gear 460', and bearing 497 which fits against housing 461. Gear 460 is secured to shaft 462 by key 454 and gear 460' is secured to shaft 462 by key 455.

Pawl mechanism 140 includes shaft 142 having at one end pawls 144 connected by pin 143 and locking washing 146. Pawls 144 are spaced apart as mirror images so that movement of shaft 142 will cause each pawl 144 to engage ratchet wheel 136 of the corresponding knife assembly 130 (see FIG. 10). Shaft 142 extends into and through shaft 462, being threaded through seat 147 and annular ring 148. Shaft 142 is configured with a series of longitudinal grooves on its surface and ring 148 has inwardly extending balls 149 that extend into the grooves of shaft 142 to permit the shaft to move along its axis and to prevent the shaft from rotating about its axis. Shaft 142 is connected at its other end to extend through bronze bushing 147. An air cylinder (not shown) is used to move shaft 142 along its axis. This movement results in pawls 144 contacting respective ratchet wheels 136 to advance each blade 120 outwardly by a predetermined amount, e.g., 0.01 mm each time it is advanced.

Figure 10:
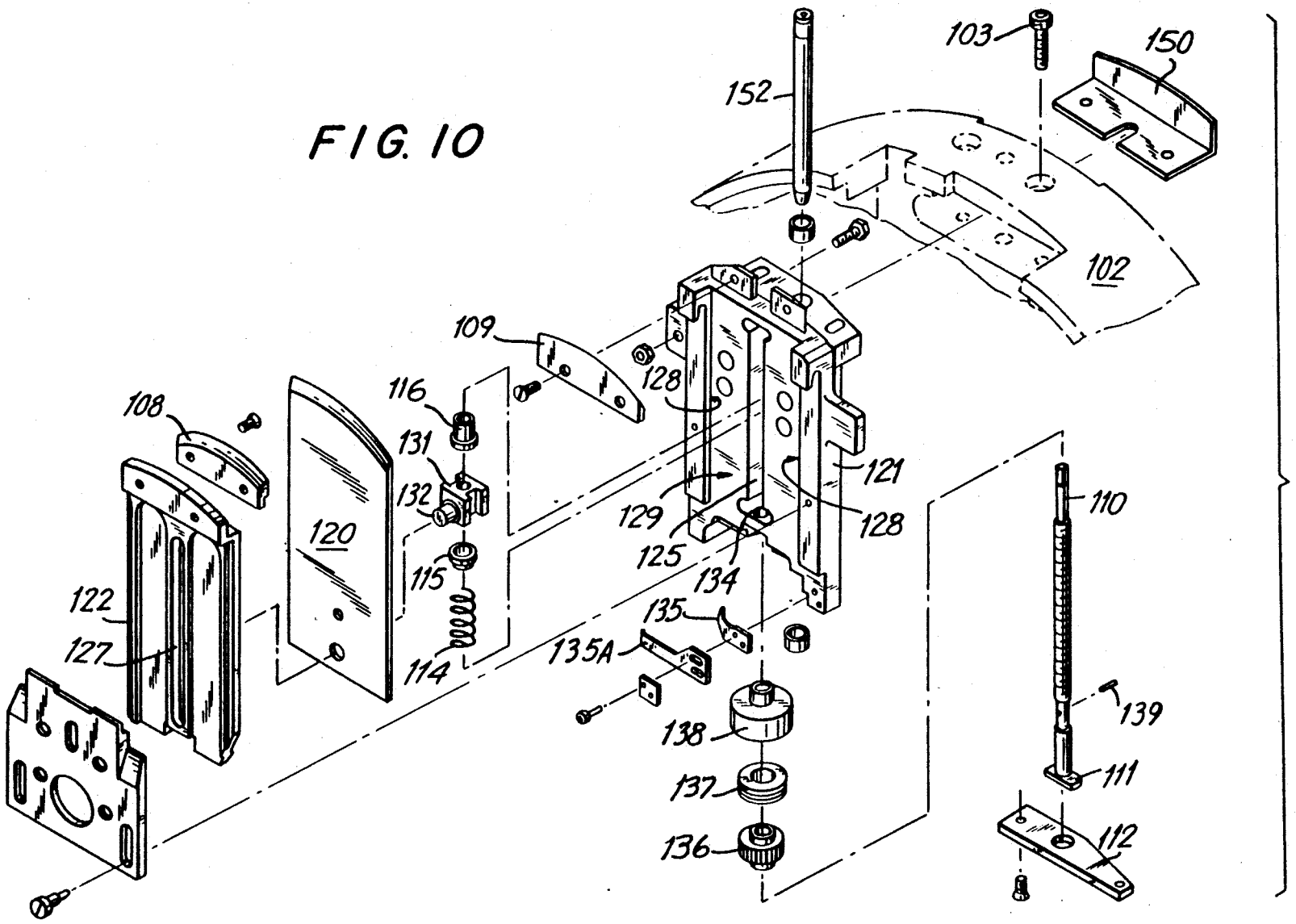
FIG. 10 is an exploded partial view of the knife advance mechanism of FIG. 1.

Referring to FIGS. 9–11, knife assemblies 130 are secured to disk 102 and between front cover 104 and disk 102. In the preferred embodiment, two knife assemblies having the same construction are used, mounted diametrically opposite each other in wheel 100. Thus, wheel 100A may need to be reground to permit such an arrangement. It is to be understood, however, that more than two knife assemblies may be used. Advantageously using more than one knife assembly provides for a more balanced wheel 100 and thus results in fewer vibrations as a result of any imbalance introduced by a single knife machine as the knife becomes worn during use and is progressively sharpened and consumed. In accordance with applicant's invention, the wheel is rotating at a substantially lower rate which minimizes the effect of any imbalance introduced at only one location on a wheel having a single blade.

Although only one knife mechanism is described, it should be understood that each knife mechanism has the same construction and operation. Referring to FIGS. 10 and 11, blade 120 is secured between base 121 and plate 122. Plate 122 has an elongated aperture 127 and base 121 has a corresponding elongated aperture 125 in parallel Which are used to control the advance and orientation of blade 120 with respect to base 121 and plate 122. Base 125 is provided with flanges 128 that extend from surface 129 which fit closely to and guide blade 120 radially to wheel 100. H-shaped slide 131 is adapted to fit into and slide along aperture 126 so that the upstanding H portions straddle surface 129 and the corresponding opposing surface of base 121. Slide 131 also has a base 132 that is configured to fit into receptacle 133 of blade 120, thereby to pin blade 120 to the relation position of slide 131 in aperture 125. Base 132 preferably extends beyond blade 120 and into aperture 127 of plate 122 to secure blade 120.

Base 121 also is provided with threaded shaft 110 that is to pass through aperture 134 of base 121, along aperture 125, and into aperture 135 at the outer portion of base 121. Slide 131 is provided with a threaded passage that interfits with threaded shaft 110 so that the position of slide 131 can be controlled by rotating shaft 110 to move slide 131 therealong.

Shaft 110 is secured to base 121 by bracket 112 so that flattened head 111 is retained between bracket 112 and base 121. Shaft 110 is threaded through, in order, ratchet wheel 136, bearing 137 and seat 138. Ratchet wheel 136 is fixed to shaft 110 by pin 139 so that as ratchet wheel 136 is contacted by pawl 144 (see FIG. 9) it will cause shaft 110 to rotate a selected arc length, thereby translating slide 131 and blade 120 a selected distance along shaft 110 radially outward. Anti backward pawl 135 and pawl spring 135' are provided, mounted to base 121 respectively to prevent ratchet wheel 136 from rotating inadvertently in the reverse direction to retract blade 120 into knife mechanism 130 or in the forward direction to advance the blade too far and to hold the pawl against the ratchet. Shaft 110 is passed through spring 114 and spring retention number 115 to exert a positive force on slide 131 to prevent slide 131 from moving except as a result of shaft 110 rotating. Bushing 116 is provided to receive the outward end of shaft 110.

In accordance with conventional knife mechanisms, blade 120 is pinched between members 108 secured to plate 122 and 109 secured to base 121 to hold the knife and minimize vibrations in the blade edge during use. Similarly, base 121 is secured to disk 102 so that flange 150 extends in an aperture in disk 102 and screws 103 secure base 121 flange 150 to disk 102. The base of flange 150 is provided for securing pin 152 and locking base 121 in position. Pin 152 passing through apertures 107 in flange 150 is provided to hold base 121 and permit base 121 to swivel while flange 150 is loose. In addition, blades 120 may be mounted at a selected angle to the axis of rotation of the wheel.

Figure 11A:
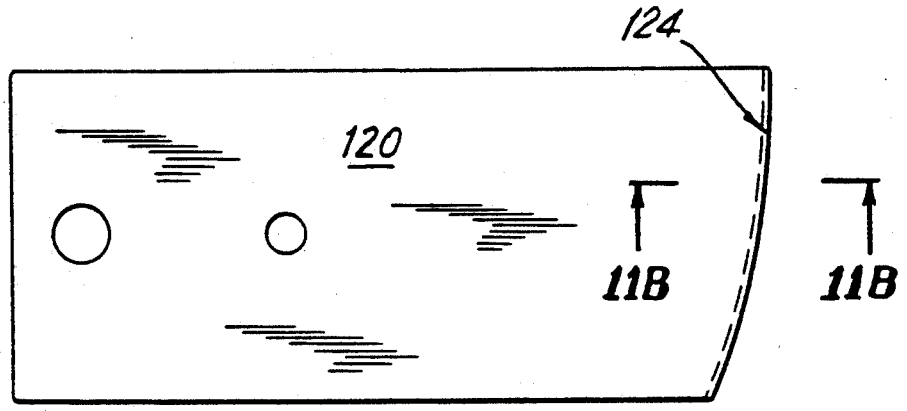
FIGS. 11A and 11B are face and partial edge sectional views of the knife blade of FIG. 1.
Figure 11B:
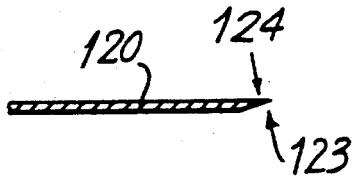

Referring to FIGS. 11A and 11B, blade 120 is shown. Surface 123 is beveled at an angle of from 14° to 16°, preferably 15°, relative to flat side 124. Blade 120 preferably has a thickness in the range of from 0.2 to about 0.3 mm, more preferably 0.25 mm and is made from chrome vanadium steel, flat within 0.001 T.I.R. The sharpening step occurs on the beveled face 123 and the deburring occurs on the flat side 124. The knife is 130.12 mm on the trailing blade edge side, 118.23 mm on the leading edge side, 59.94 mm high between the leading and trailing sides, and has a 152.4 mm radius that is tangential to the trailing edge and extends inwardly to the leading edge.

Advantageously the present invention allows the use of a substantially thinner blades in circumstances where maker 400 is maintained at the same production capacity but the speed of the cutoff device is reduced by a factor corresponding to the number of blades. This is because a relatively thicker blade is required to prevent the blade from deflecting at the higher speeds of the conventional single blade cut-off wheels. Prior art blades have commonly required a thickness of 0.012 inches (0.3 mm) for cutoff wheels operating at 5000 rpm. By operating at a slower speed, there is less deflection and a thinner blade having a thickness of 0.010 inches (0.254 mm) can be used. A thinner blade has a smaller surface area to be sharpened. Thus, less forces are required to sharpen the blade, the blade sharpens more easily, and less blade is consumed per sharpening. It has been found that, whereas it was necessary to advance the blade of a single blade wheel rotating at 5000 rpm approximately once every 20 seconds, in a double-bladed wheel in accordance with the present invention rotating at 2500 rpm the blades needed to be advanced approximately once every 45 seconds.

In the preferred embodiment, alignment of the cut-off wheel blades is accomplished by making the adjustments for one blade 120 and then checking to be sure that the same adjustments apply to the other blade 120. First, blade 120 is positioned in body 121 so that approximately 31 mm of blade is exposed above body 121 in a conventional manner for a Molins Mark 9Y or Mark 9-5 machine. It is noted that a relatively shorter blade, by about 10 mm, is used in the present invention that is used in a single blade wheel to accommodate two opposing blades having respective ratchet wheels 136 and pawls 144 being offset from the axis of shaft 142. Next, the cut-off wheel and knife blade angles are selected for the desired length articles to be severed. Then, the sharpening stone location is adjusted as described above. Next, the deburring stone is adjusted as previously mentioned.

In the embodiment of the present invention, cut-off wheel having two knife mechanisms, it has been found that the cut-off wheel speed can be reduced by half and the effective production rate is increased over a conventional machine having a single knife by about 10%. It is believed that this is accomplished because the double bladed knife operates at a slower speed with fewer vibrations and less mechanical wear. In addition, the machine generates less noise. The present invention also allows for increasing production rates to levels that could not be reliably sustained by increasing the speed of the prior known devices. In accordance with the present invention, the deburring stone mounted on the ledger provides for a more simple design and efficient deburring operation and eliminates the orbital deburring mechanism, thereby removing a substantial source of vibration, a significant source of heat (generated by the fine pitch gears at sharp angles), and substantial maintenance problems as a result of numerous parts, frequent gear wear, lubricating oil leaking through the various gears and seals and contaminating the advancing tobacco rod, and the tobacco dust that accumulates in the leaked oil, which required substantial down time to repair or rebuild the cut-off device, and then to readjust the deburring and the sharpening stones.

For example, it has been found that a conventional maker having an orbital device required complete shut down for service on an average of every 6 to 8 weeks. A device in accordance with the present invention has required complete shut down for service on an average of one to two weeks. However, whereas a prior art device having an orbital deburrinq stone requires from eight to ten hours to replace the deburring stone, the present invention requires only fifteen to twenty minutes.

In addition, it was found that retooling the conventional ledger to add housing 230 resulted in a better balanced device. Consequently, less lubrication is required and less heat and vibrations are generated. Similarly, because wheel 100 is better balanced, there is less wear on shaft 162 and consequently less heat generated.

In accordance with the present invention, the sharpening stone is driven by a motor independent of the cigarette maker machine. By replacing the belt driven sharpening stone with the motor driven sharpening stone of the present invention, potential breakdowns, service requirements and alignment problems are eliminated. In addition, by using a separate motor, the motor can be mechanically isolated from the machine further minimizing vibrations. Also a constant speed for the sharpening stone can be selected to minimize any resonant vibrations. In addition, a constant or variable speed can be selected to cancel or dampen other machine vibrations. A speed of 3400 to 3600 rpm has been found to be acceptable. Also, the motor can be driven by using conventional 110 v 60 cycle electricity.

Yet another advantage is that a machine in accordance with the present invention is easier to advance by hand and thus adjust, because of the lighter loads in the absence of any deburring stone and sharpening stone being mechanically coupled to machine motor 410. This is important in reducing the time it takes to adjust the stones and the blades, and to rethread the paper for forming the continuous tobacco rod.

One skilled in the art will appreciate that the present invention can be practiced by other than the described embodiments, which are presented for purposes of illustration and not of limitation, and the present invention is limited only by the claims which follow.

We claim:

1. An apparatus for cutting a longitudinal rod of tobacco-containing material having a thickness and advancing at a first speed in a first direction into lengths, said apparatus comprising:

a knife wheel having:

(a) a first knife and a second knife, the first and second knives being mounted in opposition on the wheel, each knife having:

(i) a blade with a first side and a second side forming a cutting edge for severing the tobacco-containing rod, (ii) a housing for the blade, (iii) a threaded rod mounted for rotation in the housing, (iv) a slide threadably mounted on the threaded rod for movement therealong and secured to the blade for moving the blade relative to the rod and the housing, and (v) a ratchet wheel secured to the threaded rod for rotation with the rod, (b) a shaft having first and second pawls for respectively engaging the ratchet wheels of the first and second knives, and (c) means for moving the shaft intermittently to engage the first and second pawls with the first and second ratchet wheels to rotate the first and second threaded rods to move the first and second blades a selected distance;

means for rotating the knife wheel at a first rate so that each knife travels in a first path and each blade cutting edge passes through the rod to sever the rod into lengths;

a sharpening stone surface;

means for rotating the sharpening stone surface at a second rate which is independent of the first rate and the first speed;

means for positioning the sharpening stone surface in the path of travel of the first and second blades so that one of the first or second sides of each blade passes along the rotating sharpening stone surface to sharpen the cutting edge;

a deburring stone surface; and means for oscillating the deburring stone surface in an arcuate second path between a first location and a second location at a frequency wherein the second path intersects the first path so that the other of the first or second sides of each blade passes along the deburring stone surface to debur the cutting edge.

2. The apparatus of claim 1 wherein the wheel further comprises more than two knives and each knife is mounted equidistant about the wheel and wherein the frequency of oscillation of the deburring stone corresponds to the number of blades so that said other side of each blade passes along the deburring stone surface.

3. The apparatus of claim 1 wherein the first rate is in the range of 2,400 to 3,400 rpm, the means for moving the shaft intermittently activates the shaft in the range of once every 30 to 45 seconds, and the selected distance is about 0.01 mm.

4. The apparatus of claim 1 wherein each blade further comprises a thickness of between 0.02 mm and 0.03 mm wherein the first side further comprises a bevelled edge at an angle of between 14° and 16° relative to the first side.

5. The apparatus of claim 1 wherein the means for rotating the sharpening stone further comprises an electric motor and the second rate is selected from among the range of 3,400 to 3,600 rpm.

6. The apparatus of claim 5 wherein the second rate is greater than the first rate.

7. The apparatus of claim 6 wherein the first rate is in the range of from 3,160 rpm to 3,340 rpm.

8. The apparatus of claim 5 wherein the means for positioning the sharpening stone comprises means for positioning the motor, said means for positioning the motor comprising:

a bracket for holding the motor in a position relative to the wheel axis;

means for adjusting the angle of the motor axis relative to the axis of rotation of the wheel, said means being interposed between the bracket and the motor; and means for moving the motor along its axis of rotation relative to said adjusting means.

9. The apparatus of claim 1 wherein the deburring stone surface defines a cylinder having a longitudinal axis that is perpendicular to the longitudinal axis of the rod.

10. The apparatus of claim 9 wherein each blade further comprises a leading edge having a first length and a trailing edge having a second length, the cutting edge further comprises a radius such that the first length is shorter than the second length by at least the thickness of the rod and the cylinder has a length so that, for each blade, the leading edge and trailing edge pass along different points of the cylinder length and said other side of the cutting edge travels along the cylinder length.

11. The apparatus of claim 1 wherein the means for oscillating the deburring stone surface further comprises:

a ledger having an aperture for passing therethrough the longitudinally advancing rod, a slot perpendicular to the aperture for receiving a blade, and a pivot point;

means for moving the ledger about its pivot point and the ledger aperture between the first position and the second position, the motion frequency being timed to the first rate so that as the wheel rotates, each blade cutting edge passes through the aperture to sever vertically the rod; and means for securing the deburring stone surface to the ledger disposed proximate to the slot so that, as the wheel rotates, each blade cutting edge passes along the deburring stone surface prior to passing through the slot.

12. The apparatus of claim 11 wherein the deburring stone surface defines a cylinder having a longitudinal axis that is perpendicular to the longitudinal axis of the rod.

13. The apparatus of claim 12 wherein each blade further comprises a leading edge having a first length and a trailing edge having a second length, the cutting edge further comprises a radius such that the first length is shorter than the second lehigh by at least the thickness of the rod and the cylinder has a length so that, for each blade, the leading edge and trailing edge pass along different points of the cylinder length and said other side of the cutting edge travels along the cylinder length.

14. An apparatus for cutting a longitudinal rod of tobacco-containing material having a thickness and a longitudinal axis and advancing at a first speed in a first direction into lengths, said apparatus comprising:

a knife wheel having a first knife and a second knife, the first and second knives being mounted in opposition on the wheel, each knife having a blade, each blade having:

a leading edge having a first length, a trailing edge having a second length, and a first side and a second side forming a cutting edge for severing the tobacco-containing rod;

means for rotating the knife wheel at a first rate so that each knife travels in a first path and each blade cutting edge passes through the rod to sever the rod into lengths;

a sharpening stone surface;

means for rotting the sharpening stone surface at a second rate which is independent of the first rate and the first speed;

means for positioning the sharpening stone surface it he path of travel of the first and second blades so that one of the first or second sides of each blade passes along the rotating sharpening stone surface to sharpen the cutting edge;

a deburring stone having:

a cylindrical surface having a longitudinal axis perpendicular to the longitudinal axis of the rod, a spindle extending from the longitudinal axis of the cylindrical surface, and means for permitting the spindle to rotate freely; and means for oscillating the deburring stone surface in an arcuate second path between a first location and a second location at a frequency wherein the second path intersects the first path so that the other of the first or second sides of each blade passes along the deburring stone surface to debur the cutting edge, the cutting edge further comprising a radius such that the first length is shorter than the second length by at least the thickness of the rod and the cylinder has a length so that, for each blade, the leading edge and trailing edge pass along different points of the cylinder length and said other side of the cutting edge travels along the cylinder length.

15. An apparatus for cutting a longitudinal rod of tobacco-containing material having a thickness and a longitudinal axis and advancing at a first speed in a first direction into lengths, said apparatus comprising:

a knife wheel having a first knife and a second knife, the first and second knives being mounted in opposition on the wheel, each knife having a blade, each blade having:

a leading edge having a first length, a trailing edge having a second length, and a first side and a second side forming a cutting edge for severing the tobacco-containing rod;

means for rotating the knife wheel at a first rate so that each knife travels in a first path and each blade cutting edge passes through the rod to sever the rod into lengths;

a sharpening stone surface;

means for rotting the sharpening stone surface at a second rate which is independent of the first rate and the first speed;

means for positioning the sharpening stone surface in the path of travel of the first and second blades so that one of the first or second sides of each blade passes along the rotating sharpening stone surface to sharpen the cutting edge;

a deburring stone having:

a cylindrical surface having a longitudinal axis perpendicular to the longitudinal axis of the rod, and a spindle in alignment with the longitudinal axis of the cylindrical surface; and means for oscillating the deburring stone surface in an arcuate second path between a first location and a second location at a frequency wherein the second path intersects the first path so that the other of the first or second sides of each blade passes along the deburring stone surface to debur the cutting edge, said means for oscillating the deburring stone surface comprising:

a ledge having an aperture for passing therethrough the longitudinally advancing rod, a slot perpendicular to the aperture for receiving a blade, and a pivot point, means for moving the ledge about its pivot point and the ledge aperture between the first position and the second position, the motion frequency being timed to the first rate so that as the wheel rotates, each blade cutting edge passes through the aperture to vertically sever the rod, and means for securing the deburring stone surface to the ledge disposed proximate to the slot so that, as the wheel rotates, each blade cutting edge passes along the deburring stone surface prior to passing through the slot, said securing means comprising a housing secured to the ledger and means for securing the spindle to the housing so that the cylinder rotates freely about its axis and extends horizontally above the aperture.

* * * * *

UNITED STATES PATENT AND TRADEMARK OFFICE

CERTIFICATE OF CORRECTION

PATENT NO. : 5,241,886
DATED : September 7, 1993
INVENTOR(S) : Marion A. Church et al.

It is certified that error appears in the above-indentified patent and that said Letters Patent is hereby corrected as shown below:

Column 17, line 37, "lehigh" should be -- length --.

Column 17, line 63, "it" should be -- in --.

Column 17, line 64, "he" should be -- the --.

Column 18, line 36, "rotting" should be -- rotating --.

Column 18, line 57, "ledge" should be --ledger --.

Column 18, line 61, "ledge" should be -- ledger --.

Column 18, line 62, "ledge" should be -- ledger --.

Column 18, line 68, "ledge" should be -- ledger --.

Signed and Sealed this

Twenty-sixth Day of April, 1994

Bruce Lehman

*Attest:*

BRUCE LEHMAN

*Attesting Officer*

*Commissioner of Patents and Trademarks*